US010650740B2

(12) United States Patent
Mao

(10) Patent No.: US 10,650,740 B2
(45) Date of Patent: May 12, 2020

(54) PIXEL DRIVING CIRCUIT AND DISPLAY DEVICE

(71) Applicant: Wuhan China Star Optoelectronics Semiconductor Display Technology Co., Ltd., Wuhan, Hubei (CN)

(72) Inventor: Peng Mao, Guangdong (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 222 days.

(21) Appl. No.: 15/754,218

(22) PCT Filed: Dec. 19, 2017

(86) PCT No.: PCT/CN2017/117170
§ 371 (c)(1),
(2) Date: Feb. 21, 2018

(87) PCT Pub. No.: WO2019/090907
PCT Pub. Date: May 16, 2019

(65) Prior Publication Data

US 2019/0385521 A1 Dec. 19, 2019

(30) Foreign Application Priority Data

Nov. 10, 2017 (CN) ..... 2017 1 1127680

(51) Int. Cl.
*G09G 3/3233* (2016.01)
*G09G 3/36* (2006.01)

(52) U.S. Cl.
CPC ..... *G09G 3/3233* (2013.01); *G09G 3/3648* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 2017/0061876 | A1* | 3/2017 | Cho | G09G 3/3233 |
| 2019/0096326 | A1* | 3/2019 | Yuan | G09G 3/3241 |
| 2019/0130833 | A1* | 5/2019 | Gao | G09G 3/3266 |

FOREIGN PATENT DOCUMENTS

| | | | |
|---|---|---|---|
| CN | 101908316 | A | 12/2010 |
| CN | 102982767 | A | 3/2013 |
| CN | 103310732 | A | 9/2013 |
| CN | 103460276 | A | 12/2013 |
| CN | 104700778 | A | 6/2015 |
| CN | 105096819 | A | 11/2015 |
| KR | 20070032448 | A | 3/2007 |

* cited by examiner

*Primary Examiner* — Amr A Awad
*Assistant Examiner* — Donna V Lui
(74) *Attorney, Agent, or Firm* — Hemisphere Law, PLLC; Zhigang Ma

(57) ABSTRACT

The present disclosure discloses a pixel driving circuit and a display device, wherein the circuit includes: a data writing switch (T1), a first reset switch (T2), a second reset switch (T3), a driving transistor (T4), an organic light-emitting diode OLED, and a first storage capacitor (C1) and a second storage capacitor (C2). The embodiments of the present disclosure can compensate for the drift of driving the threshold voltage of the thin film transistor to improve the display quality.

14 Claims, 3 Drawing Sheets

PIXEL DRIVING CIRCUIT AND DISPLAY DEVICE

RELATED APPLICATIONS

The present application is a National Phase of International Application Number PCT/CN2017/117170, filed Dec. 19, 2017, and claims the priority of China Application CN 201711127680.3, filed Nov. 10, 2017.

FIELD OF THE DISCLOSURE

The present disclosure relates to a display technology field, and more particularly to a pixel driving circuit and a display device.

BACKGROUND OF THE DISCLOSURE

Organic light-emitting diode (OLED) display devices have the advantages of low power consumption, high color gamut, high brightness, high resolution, wide viewing angle and high response speed. The OLED display device can be divided into two categories: a passive matrix OLED (PMOLED) and an active matrix OLED (AMOLED) according to a driving mode. Wherein the AMOLED has a matrix arrangement of pixels, belonging to the active display type, high luminous efficiency, usually used for high-definition large-size display device.

AMOLED is a current-driven device. When current flows through the organic light-emitting diode, the organic light-emitting diode emits light, and the light-emitting brightness is determined by the current flowing through the organic light-emitting diode itself. Most existing integrated circuits (ICs) only transmit voltage signals, so AMOLED's pixel driving circuit needs to complete the task of converting voltage signals into current signals. The traditional AMOLED pixel drive circuit is usually 2T1C, that is, the structure of two thin film transistors plus a capacitor to convert the voltage to current.

The 2T1C pixel driving circuit traditionally used for AMOLED is sensitive to the threshold voltage and the channel mobility of the thin film transistor, the startup voltage and the quantum efficiency of the organic light-emitting diode, and the transient process of the power supply. The threshold voltage of the driving thin film transistor drifts with the working time, resulting in the unstable light emitting of the organic light-emitting diode, causing the brightness difference of the pixel driving circuit and reducing the display quality.

SUMMARY OF THE DISCLOSURE

The embodiment of the present disclosure provides a pixel driving circuit and a display device, which can compensate for the drift of driving the threshold voltage of the thin film transistor and improve the display quality.

According to a first aspect, an embodiment of the present disclosure provides a pixel driving circuit including a data writing switch, a first reset switch, a second reset switch, a driving transistor, an organic light-emitting diode OLED, a first storage capacitor and a second storage capacitor.

The source of the data writing switch is connected to a data line, the drain of the data writing switch is connected to a first node.

The source of the first reset switch transistor is connected to a first reference voltage, the drain of the first reset switch transistor is connected to a second node.

The source of the second reset switch is connected to a high level, the drain of the second reset switch is connected to a third node.

The gate of the driving transistor is connected to the first node, the source of the driving transistor is connected to the third node, the drain of the driving transistor is connected to an anode of the organic light-emitting diode.

The first terminal of the first storage capacitor is connected to the third node, the second terminal of the first storage capacitor is connected to the second node.

The first terminal of the second storage capacitor is connected to the second node and the second terminal of the second storage capacitor is connected to the first node.

With reference to the first aspect, in a first possible embodiment of the first aspect, the circuit further includes: the gates of the first reset switch and the data writing switch are both connected to a scan line, the gate of the second reset switch is connected to a first control signal, the data line is configured to write a data voltage when the data driving switch, the first reset switch and the second reset switch are turned on, so that the second storage capacitor stores the data voltage.

With reference to the first aspect, or any one of the foregoing possible embodiments of the first aspect, in a second possible embodiment of the first aspect, the circuit further includes: a compensating switch, wherein the source of the compensating switch is connected to a second reference voltage, the gate of the compensating switch is connected to a second control signal, the drain of the compensating switch is connected to the drain of the driving transistor and the anode of the organic light-emitting diode; after the second storage capacitor stores the data voltage, the first storage capacitor is configured to store the threshold voltage of the driving transistor when the data writing switch, the first reset switch and the compensating switch are turned on.

With reference to the first aspect, or any one of the foregoing possible embodiments of the first aspect, in a third possible embodiment of the first aspect, the circuit further includes: a first control switch, a second control switch and a third control switch. The source of the first control switch is connected to a supply voltage, the gate of the first control switch is connected to a third control signal, and the drain of the first control switch is connected to the source of the driving transistor.

The source of the second control switch is connected to the drain of the driving transistor and the drain of the compensating transistor, the gate of the second control switch is connected to the control signal, and the drain of the second control switch is connected to the anode of the organic light-emitting diode.

The source of the third control switch is connected to the second node, the gate of the third control switch is connected to a fourth control signal, the drain of the third control switch is connected to the first node.

After the first storage capacitor stores the threshold of the driving transistor, the first control switch, the second control switch and the third control switch are turned on at the same time, so that the organic light-emitting diode OLED emits light.

According to a second aspect, an embodiment of the present disclosure provides a display device including the pixel driving circuit described in the first aspect or any one of the possible embodiments of the first aspect.

In the embodiment of the present disclosure, since the first terminal of the first storage capacitor is connected to the third node, the second terminal of the first storage capacitor is connected to the second node, the first terminal of the second storage capacitor is connected to the second node and the second terminal of the second storage capacitor is connected to the first node, therefore the threshold voltage of the driving transistor can be stored in the first storage capacitor first, and can be obtained from the saturation current equation of the organic light-emitting diode OLED. The current flowing through the organic light-emitting diode OLED is controlled by the first reference voltage and the data voltage such that the current flowing through the organic light-emitting diode OLED is no longer influenced by the threshold voltage of the driving TFT, which can compensate for the drifting of the driving threshold voltage of the thin film transistor so as to improve the uniformity of the OLED display and improve the display quality.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION OF PREFERRED EMBODIMENTS

The technical solutions in the embodiments of the present disclosure are clearly and completely described below with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

It should be understood that the terms "include" and "including", when used in this specification and the appended claims, indicate the presence of stated features, integers, steps, operations, elements, and/or components, but do not preclude the presence or addition of one or more other features, integers, steps, operations, elements, components, and/or groups thereof.

It is also to be understood that the terminology used in the description of the disclosure herein is for the purpose of describing particular embodiments only and is not intended to limit the disclosure. As used in the description of the disclosure and the appended claims, the singular forms "a", "an" and "the" are intended to include the plural forms unless the context clearly indicates otherwise.

It is further to be understood that the term "and/or" as used in the specification and appended claims, refers to any and all possible combinations of one or more of the associated listed items.

As used in this specification and the appended claims, the term "if" may be interpreted as "when" or "once" or "in response to a determination" or "in response to a detection" as the context dictates. Similarly, the phrase "if determined" or "if [described condition or event] is detected" may be interpreted from the context as meaning "once determined" or "in response to a determination" or "once [described condition or event] is detected" or "in response to detected [described condition or event]".

Figure 1:
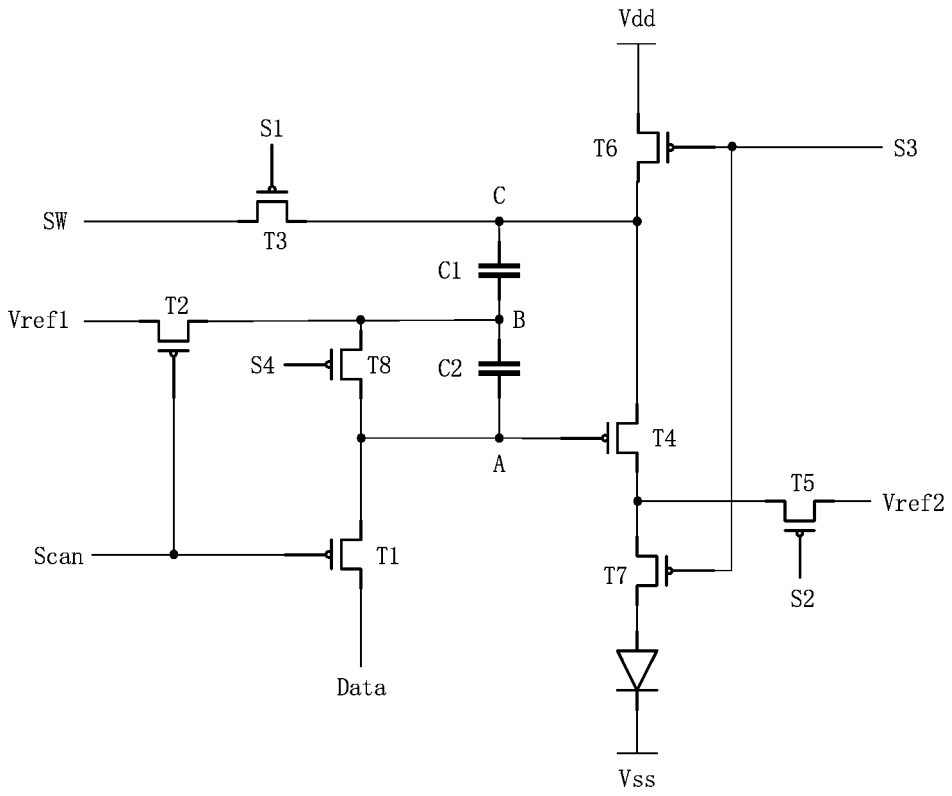
FIG. 1 is a schematic structural diagram of a pixel driving circuit according to an embodiment of the present disclosure.

Referring to FIG. 1, FIG. 1 is a schematic structural diagram of a pixel driving circuit according to an embodiment of the present disclosure. The circuit includes a data writing switch T1, a first reset switch T2, a second reset switch T3, a driving transistor T4, an organic light-emitting diode OLED, a first storage capacitor C1 and a second storage capacitor C2.

The source of the data writing switch T1 is connected to a data line Data, and the drain of the data writing switch T1 is connected to a first node A.

The source of the first reset switch transistor T2 is connected to a first reference voltage Vref1, and the drain of the first reset switch transistor T2 is connected to a second node B.

The source of the second reset switch T3 is connected to a high level SW, and the drain of the second reset switch T3 is connected to a third node C.

The gate of the driving transistor T4 is connected to the first node A, the source of the driving transistor T4 is connected to the third node C, and the drain of the driving transistor T4 is connected to the anode of the organic light-emitting diode.

The first terminal of the first storage capacitor C1 is connected to the third node C, the second terminal of the first storage capacitor C1 is connected to the second node B. The first storage capacitor C1 has two terminals, one terminal of the first storage capacitor C1 is referred to as a first terminal, and the other terminal of the first storage capacitor C1 is referred to as a second terminal.

The first terminal of the second storage capacitor C2 is connected to the second node B and the second terminal of the second storage capacitor C1 is connected to the first node A. The second storage capacitor C2 has two terminals, one terminal of the second storage capacitor C2 is referred to as a first terminal, and the other terminal of the second storage capacitor C2 is referred to as a second terminal.

The circuit further includes: the gates of the first reset switch T2 and the data writing switch T1 both connected to a scan line Scan, the gate of the second reset switch T3 is connected to a first control signal S1. First, the data line Data is configured to write the data voltage $V_{data}$, when the data writing switch T1, the first reset switch T2 and the second switch T3 are turned on, the second storage capacitor C2 stores the data voltage $V_{data}$. Next, the second reference voltage $V_{ref2}$ is inputted between the drain of the driving transistor T4 and the anode of the organic light-emitting diode OLED, such that the voltage $V_C$ of the third node C is equal to the voltage difference of the data voltage $V_{data}$ minus the threshold voltage $V_{th}$ of the driving transistor T4, thereby the threshold voltage $V_{th}$ of the driving transistor T4 is stored in the first storage capacitor C1. Finally, the power voltage $V_{dd}$ at the third node C is inputted to short the second storage capacitor C2 so that the potential $V_A$ of the first node A is as shown in Equation 1-1:

$$V_A=V_{dd}-V_{data}+V_{th}+V_{ref1} \quad 1\text{-}1$$

Substituting Equation 1-1 into the saturation current equation of the organic light-emitting diode OLED yields Equation 1-2:

$$I_{OLED}=K(V_{ref1}-V_{data})^2 \quad 1\text{-}2$$

From Equation 1-2, it can be known that the saturation current of the organic light-emitting diode OLED is no longer influenced by the threshold voltage $V_{th}$ of the driving transistor T4, so that the current of the pixel compensation circuit is compensated and the influence of $V_{th}$ is eliminated.

The circuit further includes: a compensating switch T5, wherein the source of the compensating switch T5 is connected to a second reference voltage $V_{ref2}$, the gate of the compensating switch T5 is connected to a second control signal S2, the drain of the compensating switch T5 is connected to the drain of the driving transistor T4 and the anode of the organic light-emitting diode.

After the second storage capacitor C2 stores the data voltage $V_{data}$, the first storage capacitor C1 is configured to store a threshold voltage $V_{th}$ of the driving transistor T4 when the data writing switch T1, the first reset switch T2 and the compensating switch T5 are turned on.

Due to the access of the compensating switch T5, the level of the second control signal S2 can be set by the timing controller TCON so as to control the access of the second reference voltage $V_{ref2}$. Compared with artificially inputting the second reference voltage $V_{ref2}$ between the drain of the driving transistor T4 and the anode of the organic light-emitting diode OLED, the convenience of operation is improved.

The circuit may further includes: a first control switch T6, a second control switch T7 and a third control switch T8. Wherein the source of the first control switch T6 is connected to a supply voltage $V_{dd}$, the gate of the first control switch T6 is connected to a third control signal S3, and the drain of the first control switch T6 is connected to the source of the driving transistor T4. The source of the second control switch T7 is connected to the drain of the driving transistor T4 and the drain of the compensating transistor T5, the gate of the second control switch T7 is connected to the control signal S3, and the drain of the second control switch T7 is connected to the anode of the organic light-emitting diode. The source of the third control switch T8 is connected to the second node B, the gate of the third control switch T8 is connected to a fourth control signal S4, and the drain of the third control switch T8 is connected to the first node A.

After the first storage capacitor C1 stores the threshold $V_{th}$ of the driving transistor T4, the first control switch T6, the second control switch T7 and the third control switch T8 are turned on at the same time, so that the organic light-emitting diode OLED emits light.

Before the first control switch T6, the second control switch T7, and the third control switch T8 are turned on at the same time, the second control switch T7 is turned off so that no current flows in the organic light-emitting diode OLED, thereby avoiding the problem of the light emitting of the organic light-emitting diode OLED caused by the leakage.

Specifically, the organic light-emitting diode OLED may be an AMOLED, or may be other types of light emitting devices. Specifically, the first control signal S1, the second control signal S2, the third control signal S3 and the fourth control signal S4 are provided by the timing controller TCON. The first reference voltage $V_{ref1}$ and the second reference voltage $V_{ref2}$ are preset constant voltages. The first reference voltage $V_{ref1}$ is greater than the data voltage written by the data line $V_{data}$, so that the organic light-emitting diode can emit light normally. Optionally, when the first reference voltage $V_{ref1}$ is preset, the set first reference voltage $V_{ref1}$ is larger than the data voltage written in the data line $V_{data}$. Optionally, if the data voltage with a larger adjustable range is needed, the first reference voltage $V_{ref1}$ may be increased.

The data driving switch T1, the first reset switch T2, the second reset switch T3, the driving transistor T4, the compensating transistor T5, the first control switch T6, the second control switch T7 and the third control switch T8 are one of a polysilicon thin film transistor, an amorphous silicon thin film transistor, a zinc oxide based thin film transistor and an organic thin film transistor. It should be understood that, the data driving switch T1, the first reset switch T2, the second reset switch T3, the driving transistor T4, the compensating transistor T5, the first control switch T6, the second control switch T7 and the third control switch T8 may belong to the same transistor type or may belong to different transistor types. For example, these switches are all organic thin film transistors. For another example, the data writing switch T1 is a polysilicon thin film transistor, the first reset switch T2 is an amorphous silicon thin film transistor, the second reset switch T3 is a zinc oxide based thin film transistor, the compensating switch T4 is an organic thin film transistor, the first control switch T5 is an organic thin film transistor, the second control switch T6 is a polysilicon thin film transistor, the third control switch T7 is an organic thin film transistor, and the driving transistor T8 is a polysilicon transistor.

The pixel driving circuit has three work phases: resetting and data writing stage, compensating stage and light-emitting stage. The three phases will be described next.

In the resetting and data writing stage, the first control signal S1 and the scan signal Scan are set at a low level, and the second control signal S2, the third control signal S3 and the fourth control signal S4 are set at a high level. Therefore, the data writing switch T1, the first reset switch T2, and the second switch T3 are turned on. The compensating switch T5, the first control switch T6, the second control switch T7 and the third control switch T8 are in turned off. The voltage at the gate of the driving transistor T4 is equal to the data voltage $V_{data}$ written by the data line Data.

Figure 2:
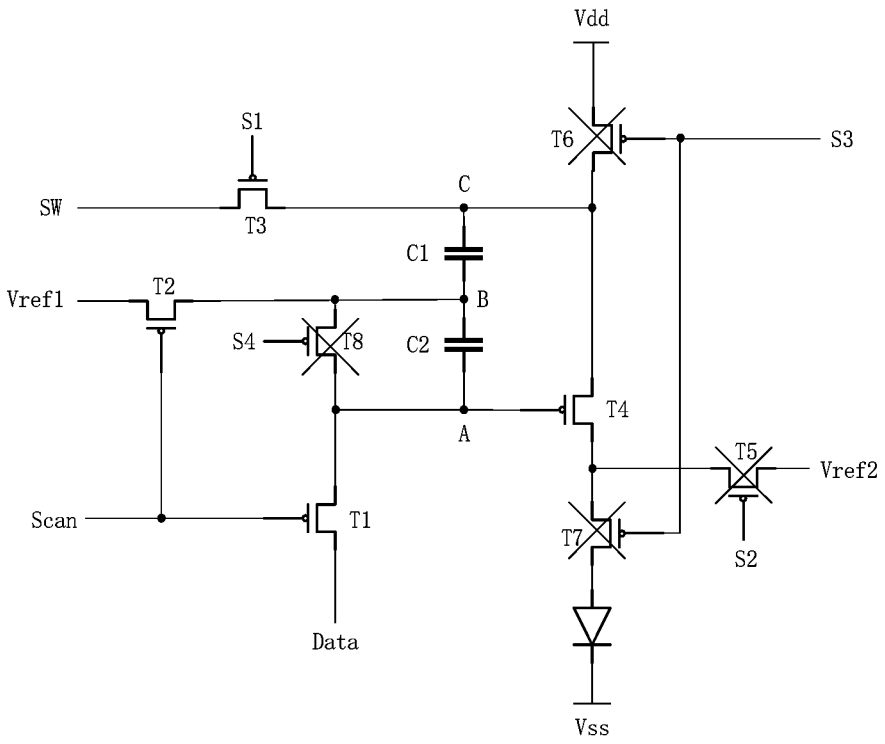
FIG. 2 is an equivalent circuit diagram of a resetting and data writing stage of a pixel driving circuit according to an embodiment of the present disclosure.

Referring to FIG. 2, FIG. 2 is an equivalent circuit diagram of a resetting and data writing stage of a pixel driving circuit according to an embodiment of the present disclosure. as shown in FIG. 2, the first reference voltage $V_{ref1}$ and the high level SW are input into the pixel driving circuit. The first storage capacitor C1 discharges the stored charges to prevent the residual charges in the previous stage of light-emitting process from interfering with the current light-emitting process. The data line Data is written into the data voltage $V_{data}$ through the data writing switch T1. The voltage at the gate of the driving transistor T4 is equal to the data voltage $V_{data}$, that is, the voltage $V_A$ at the first node A is as shown in Equation 1-3:

$$V_A=V_{data} \quad 1\text{-}3$$

From Equation 1-3, the data voltage $V_{data}$ is stored in the second storage capacitor C2.

The compensating stage is to set the scan signal Scan and the second control signal S2 at a low level, and the first control signal S1, the third control signal S3 and the fourth control signal S4 are set at a high level. Therefore, the data writing switch T1, the first switch transistor T2 and the switch transistor T5 are turned on. The second reset switch T3, the first control switch T6, the second control switch T7 and the third control switch T8 are turned off. When the potential at the third node C is equal to the data voltage $V_{data}$ minus the threshold voltage $V_{th}$ of the driving transistor T4, the driving transistor T4 is in the off state.

Figure 3:
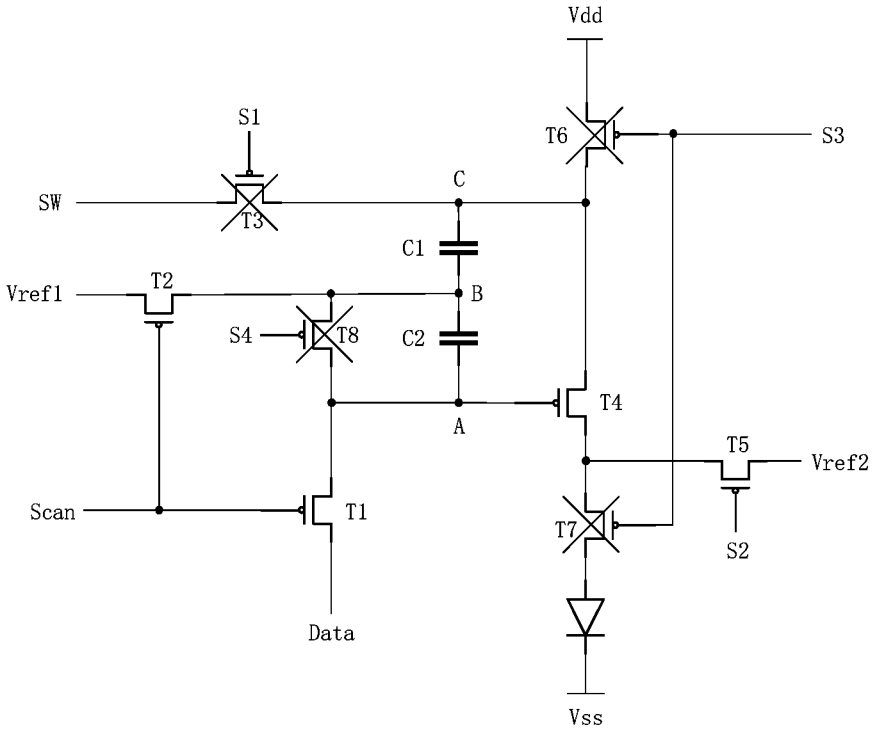
FIG. 3 is an equivalent circuit diagram of a compensating stage of a pixel driving circuit according to an embodiment of the present disclosure.

Referring to FIG. 3, FIG. 3 is an equivalent circuit diagram of a compensating stage of a pixel driving circuit according to an embodiment of the present disclosure. As shown in FIG. 3, the first storage capacitor C1 discharges the charge through the driving transistor T4 and the compensating switch T5. After the release is completed, the potential $V_C$ at the third node C is:

$$V_C=V_{data}-V_{th} \quad 1\text{-}4$$

Therefore, the threshold voltage $V_{th}$ of the driving transistor T4 is stored in the first storage capacitor C1.

The light-emitting stage sets the third control signal S3 and the fourth control signal S4 to a low level, and the first control signal S1, the second control signal S2 and the scan signal Scan are set to a high level. Therefore, the first control switch T6, the second control switch T7 and the third control switch T8 are turned on; the data writing switch T1, the first reset switch T2, the second switch T3 and the compensating switch T5 are turned off; The gate-source voltage $V_{gs}$ of the driving transistor T4 drives the organic light-emitting diode OLED to emit light. During the light-emitting stage, the gate-source voltage $V_{gs}$ of the driving transistor T4 remains unchanged until the image of the next frame is refreshed.

Before the first control switch T6, the second control switch T7, and the third control switch T8 are turned on at the same time, the second control switch T7 is turned off so that no current flows in the organic light-emitting diode OLED, thereby avoiding the problem of the light emitting of the organic light-emitting diode OLED caused by the leakage.

Figure 4:
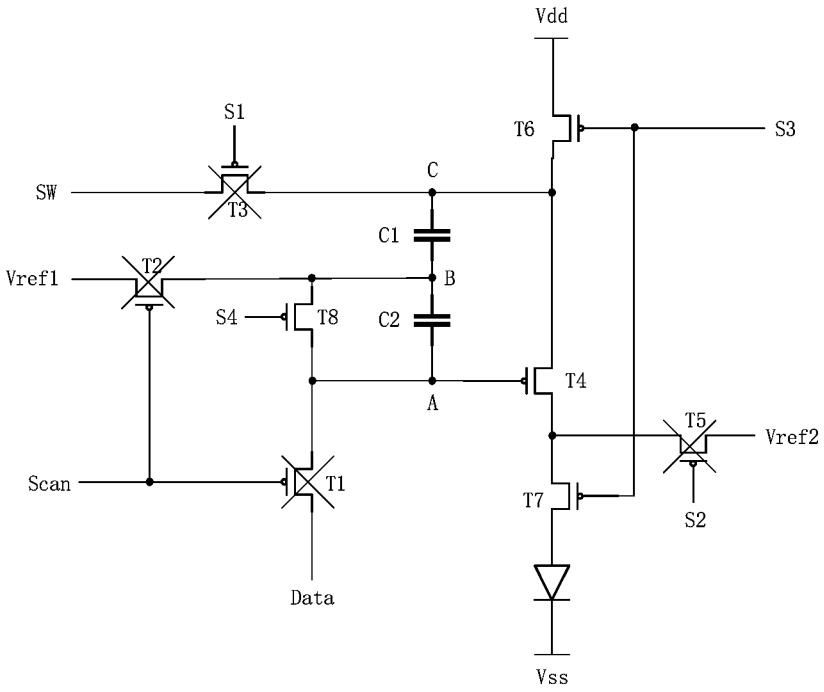
FIG. 4 is an equivalent circuit diagram of a light-emitting stage of a pixel driving circuit according to an embodiment of the present disclosure.

Referring to FIG. 4, FIG. 4 is an equivalent circuit diagram of a light-emitting stage of a pixel driving circuit according to an embodiment of the present disclosure. As shown in FIG. 4, the power voltage $V_{dd}$ is written into the circuit through the first control switch T6. The organic light-emitting diode OLED is electrically connected to the circuit through the second control switch T7. The potential $V_C$ of the third node C is changed to:

$$V_C=V_{dd} \quad 1\text{-}5$$

Since the third control switch T8 is turned on, the second storage capacitor C2 is short-circuited so that the potential $V_A$ of the first node A is changed to:

$$V_A=V_{ref1} \quad 1\text{-}6$$

Because the first node A and the third node C are equal in potential variation, there is:

$$V_A-V_{ref1}-V_{dd}-(V_{data}-V_{th}) \quad 1\text{-}7$$

That is, the potential $V_A$ of the first node A can be expressed as:

$$V_A=V_{dd}-V_{data}+V_{th}V_{ref1} \quad 1\text{-}8$$

Therefore, the gate voltage $V_s$ of the driving transistor T4 is:

$$V_s=V_A=V_{dd}-V_{data}+V_{th}+V_{ref1} \quad 1\text{-}9$$

The source voltage $V_g$ of the driving transistor T4 is:

$$V_g=V_C=V_{dd} \quad 1\text{-}10$$

The gate-source voltage $V_{gs}$ of the driving transistor T4 is:

$$V_{gs}=V_g-V_g=V_{ref1}-V_{data}+V_{th} \quad 1\text{-}11$$

The saturation current through the organic light-emitting diode OLED is:

$$I_{OLED}=K(V_{gs}-V_{th})^2 \quad 1\text{-}12$$

Where K is a parameter related to the driving transistor T4, $V_{gs}$ is a gate-source voltage of the driving transistor T4, $V_{th}$ is a threshold voltage of the driving transistor T4. Substituting Equation 1-11 into Equation 1-12 yields Equation 1-13:

$$I_{OLED}=K(V_{ref1}-V_{data})^2 \quad 1\text{-}13$$

As shown in Equation 1-13, in the light-emitting stage, the saturation current of the organic light-emitting diode OLED is no longer affected by the threshold voltage $V_{th}$ of the driving transistor T6, so that the current compensation by the pixel compensation circuit is realized, and the influence of $V_{th}$ is eliminated. Moreover, there is no supply voltage $V_{dd}$ in the equation, so that the influence of the supply voltage $V_{dd}$ on the pixel compensation circuit is eliminated, and the problem of the voltage drop IR-drop is avoided.

In the pixel driving circuit shown in FIG. 1, since the first terminal of the first storage capacitor C1 is connected to the third node C, the second terminal of the first storage capacitor C1 is connected to the second node B. The first terminal of the second storage capacitor C2 is connected to the second node B, the second terminal of the second storage capacitor C1 is connected to the first node A. Therefore, the threshold voltage $V_{th}$ of the driving transistor T4 can be stored in the first storage capacitor C1 first, and can be obtained from the saturation current equation of the organic light-emitting diode OLED. The current flowing through the organic light-emitting diode OLED is controlled by the first reference voltage $V_{ref1}$ and the data voltage $V_{data}$ so that the current flowing through the organic light-emitting diode OLED is no longer affected by the threshold voltage $V_{th}$ of the driving TFT, which can compensate for the drifting of the driving threshold voltage of the thin film transistor so as to improve the uniformity of the OLED display and improve the display quality.

Figure 5:
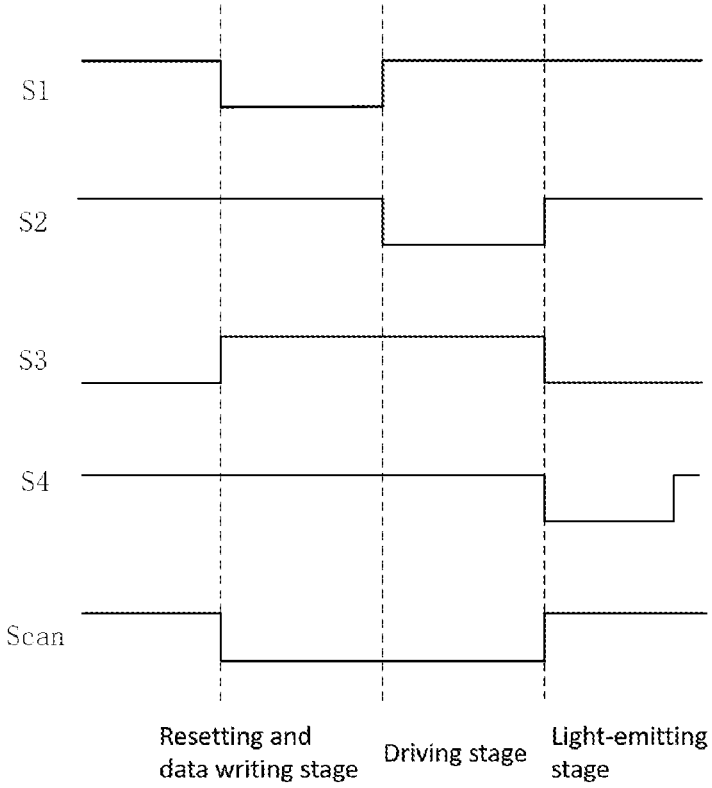
FIG. 5 is a driving timing diagram of a pixel driving circuit according to an embodiment of the present disclosure.

Referring to FIG. 5, FIG. 5 is a driving timing diagram of a pixel driving circuit according to an embodiment of the present disclosure. The data connected to the scan signal Scan in FIG. 5 is the data writing switch T1 and the first reset switch T2, the second reset switch T2 is connected to the first control signal S1, the compensating switch T5 is connected to the second control signal S2, the first control switch T6 and the third control switch T7 are connected to the third control signal S3, the third control switch T8 connected to the fourth control signal S4 is an active-low switch. That is, when these signals are at a low level, the switches connected to the signals are turned on.

It should be understood that the switches to which these signals are connected may also be high-level switches. For example, the data writing switch T1 and the first reset switch T2 are high-level active switches, the second reset switch T2 is an active-low switch, the compensating switch T5 is a high-level switch, the first control switch T6 and the third control switch T7 are active-low switches, the third control switch T8 is an active low switch, but the switches connected to the same signal must be an active switch of the same type. For example, the data writing switch T1 and the first reset switch T2 connected to the scan signal Scan must be of the same type and level.

As shown in FIG. 5, during the resetting and data writing stages, the scan signal Scan and the first control signal S1 are at an active level, and the second control signal S2, the third control signal S3 and the fourth control signal S4 are at an inactive level. In the compensating stage, the scan signal Scan and the second control signal S2 are at an active level, and the first control signal S1, the third control signal S3 and the fourth control signal S4 are at an inactive level. During the light-emitting stage, the third control signal S3 and the fourth control signal S4 are at an active level, and the first control signal S1, the first control signal S2 and the scan signal Scan are at an inactive level. The working process of driving the timing may refer to the working process of the pixel driving circuit described in FIG. 1, and details are not described herein again.

In the timing diagram of the pixel driving circuit shown in FIG. 5, since the first terminal of the first storage capacitor C1 is connected to the third node C, the second terminal of the first storage capacitor C1 is connected to the second node B, the first terminal of the second storage capacitor C2 is connected to the second node B, and the second terminal of the second storage capacitor C1 is connected to the first node A, the threshold voltage $V_{th}$ of the driving transistor T4 can be stored in the first storage capacitor C1 first. It can be concluded from the saturation current equation of the organic light-emitting diode OLED that the current flowing through the organic light-emitting diode OLED is controlled by the first reference voltage $V_{ref1}$ and the data voltage $V_{data}$, so that the current flowing through the organic light-emitting diode OLED is no longer influenced by the threshold voltage V of the driving TFT and can compensate the drifting of the threshold voltage of the driving TFT so as to improve the uniformity of the OLED display and improve the display quality.

In another embodiment of the present disclosure, a display device is provided. The display device includes the pixel driving circuit described in the method embodiment shown in FIG. 1.

In summary, although the present disclosure has been disclosed by the preferred embodiments, the preferred embodiments are not intended to limit the present disclosure. Those skilled in the art may make various changes and modifications without departing from the spirit and scope of the present disclosure, and therefore, the protection scope of the present disclosure shall be defined by the appended claims.

The above is the preferred embodiment of the present disclosure, it should be noted that those skilled in the art may make various improvements and modifications without departing from the principle of the present disclosure, and these improvements and modifications are also deemed to be within the protection scope of the present disclosure.

What is claimed is:

1. A pixel driving circuit, comprising a data writing switch, a first reset switch, a second reset switch, a driving transistor, an organic light-emitting diode, a first storage capacitor and a second storage capacitor; wherein a source of the data writing switch is connected to a data line, a drain of the data writing switch is connected to a first node;

a source of the first reset switch transistor is connected to a first reference voltage, a drain of the first reset switch transistor is connected to a second node;

a source of the second reset switch is connected to a high level, a drain of the second reset switch is connected to a third node;

a gate of the driving transistor is connected to the first node, a source of the driving transistor is connected to the third node, a drain of the driving transistor is connected to an anode of the organic light-emitting diode;

a first terminal of the first storage capacitor is connected to the third node, a second terminal of the first storage capacitor is connected to the second node;

a first terminal of the second storage capacitor is connected to the second node, and a second terminal of the second storage capacitor is connected to the first node, wherein gates of the first reset switch and the data writing switch are both connected to a scan line, a gate of the second reset switch is connected to a first control signal, the data line is configured to write a data voltage when the data writing switch, the first reset switch and the second reset switch are turned on, so that the second storage capacitor stores the data voltage.

2. The pixel driving circuit according to claim 1, further comprising a compensating switch, wherein a source of the compensating switch is connected to a second reference voltage, a gate of the compensating switch is connected to a second control signal, a drain of the compensating switch is connected to the drain of the driving transistor and the anode of the organic light-emitting diode; after the second storage capacitor stores the data voltage, the first storage capacitor is configured to store a threshold voltage of the driving transistor when the data writing switch, the first reset switch and the compensating switch are turned on.

3. The pixel driving circuit according to claim 2, wherein the first reference voltage and the second reference voltage are preset constant voltages.

4. A pixel driving circuit, comprising a data writing switch, a first reset switch, a second reset switch, a driving transistor, an organic light-emitting diode, a first storage capacitor and a second storage capacitor; wherein a source of the data writing switch is connected to a data line, a drain of the data writing switch is connected to a first node;

a source of the first reset switch transistor is connected to a first reference voltage, a drain of the first reset switch transistor is connected to a second node;

a source of the second reset switch is connected to a high level, a drain of the second reset switch is connected to a third node;

a gate of the driving transistor is connected to the first node, a source of the driving transistor is connected to the third node, a drain of the driving transistor is connected to an anode of the organic light-emitting diode;

a first terminal of the first storage capacitor is connected to the third node, a second terminal of the first storage capacitor is connected to the second node;

a first terminal of the second storage capacitor is connected to the second node, and a second terminal of the second storage capacitor is connected to the first node, wherein the pixel driving circuit further comprises a first control switch, a second control switch and a third control switch, a source of the first control switch is connected to a power supply voltage, a gate of the first control switch is connected to a third control signal, a drain of the first control switch is connected to a source of the driving transistor;

a source of the second control switch is connected to a drain of the driving transistor and a drain of a compensating transistor, a gate of the second control switch is connected to the control signal, a drain of the second control switch is connected to the anode of the organic light-emitting diode;

a source of the third control switch is connected to the second node, a gate of the third control switch is connected to a fourth control signal, a drain of the third control switch is connected to the first node;

after the first storage capacitor stores a threshold voltage of the driving transistor, the first control switch, the second control switch and the third control switch are turned on at the same time, so that the organic light-emitting diode emits light.

5. The pixel driving circuit according to claim 4, wherein before the first control switch, the second control switch and the third control switch being turned on, the second control switch is turned off so that no current flows in the organic light-emitting diode.

6. The pixel driving circuit according to claim 4, wherein the first reference voltage is greater than the data voltage.

7. The pixel driving circuit according to claim 4, wherein the data writing switch, the first reset switch, the second reset switch, the driving transistor, the compensating transistor, the first control switch, the second control switch and the third control switch are one of a polysilicon thin film transistor, an amorphous silicon thin film transistor, a zinc oxide based thin film transistor or an organic thin film transistor.

8. A display device, comprising a pixel driving circuit, wherein the pixel driving circuit comprises a data writing switch, a first reset switch, a second reset switch, a driving transistor, an organic light-emitting diode, a first storage capacitor and a second storage capacitor;

a source of the data writing switch is connected to a data line, a drain of the data writing switch is connected to a first node;

a source of the first reset switch transistor is connected to a first reference voltage, a drain of the first reset switch transistor is connected to a second node;

a source of the second reset switch is connected to a high level, a drain of the second reset switch is connected to a third node;

a gate of the driving transistor is connected to the first node, a source of the driving transistor is connected to the third node, a drain of the driving transistor is connected to an anode of the organic light-emitting diode;

a first terminal of the first storage capacitor is connected to the third node, a second terminal of the first storage capacitor is connected to the second node;

a first terminal of the second storage capacitor is connected to the second node and a second terminal of the second storage capacitor is connected to the first node;

wherein gates of the first reset switch and the data writing switch are both connected to a scan line, a gate of the second reset switch is connected to a first control signal, the data line is configured to write a data voltage when the data writing switch, the first reset switch and the second reset switch are turned on, so that the second storage capacitor stores the data voltage.

9. The display device according to claim 8, wherein the pixel driving circuit further comprises a compensating switch, wherein a source of the compensating switch is connected to a second reference voltage, a gate of the compensating switch is connected to a second control signal, a drain of the compensating switch is connected to the drain of the driving transistor and the anode of the organic light-emitting diode; after the second storage capacitor stores the data voltage, the first storage capacitor is configured to store a threshold voltage of the driving transistor when the data writing switch, the first reset switch and the compensating switch are turned on.

10. The display device according to claim 9, wherein the first reference voltage and the second reference voltage are preset constant voltages.

11. The display device according to claim 8, wherein the pixel driving circuit further comprises a first control switch, a second control switch and a third control switch, a source of the first control switch is connected to a power supply voltage, a gate of the first control switch is connected to a third control signal, a drain of the first control switch is connected to a source of the driving transistor;

a source of the second control switch is connected to a drain of the driving transistor and a drain of a compensating transistor, a gate of the second control switch is connected to the control signal, a drain of the second control switch is connected to the anode of the organic light-emitting diode;

a source of the third control switch is connected to the second node, a gate of the third control switch is connected to a fourth control signal, a drain of the third control switch is connected to the first node;

after the first storage capacitor stores a threshold of the driving transistor, the first control switch, the second control switch and the third control switch are turned on at the same time, so that the organic light-emitting diode emits light.

12. The display device according to claim 11, wherein before the first control switch, the second control switch and the third control switch being turned on, the second control switch is turned off so that no current flows in the organic light-emitting diode.

13. The display device according to claim 11, wherein the first reference voltage is greater than the data voltage.

14. The display device according to claim 11, wherein the data writing switch, the first reset switch, the second reset switch, the driving transistor, the compensating transistor, the first control switch, the second control switch and the third control switch are one of a polysilicon thin film transistor, an amorphous silicon thin film transistor, a zinc oxide based thin film transistor or an organic thin film transistor.

* * * * *